US005910196A

United States Patent [19]

Huang

[11] Patent Number: 5,910,196

[45] Date of Patent: Jun. 8, 1999

[54] REVERSIBLE RATCHET SCREWDRIVER

[76] Inventor: Chiu-Tong Huang, 9/F., No. 752-8, Wen-Hsin Rd., Sec. 4, Taichung City, Taiwan

[21] Appl. No.: 09/022,481

[22] Filed: Feb. 12, 1998

[51] Int. Cl.[6] ..... B25B 13/46

[52] U.S. Cl. ..... 81/60; 81/63.1; 192/43.1

[58] Field of Search ..... 81/60–63.2; 192/43.1

[56] References Cited

U.S. PATENT DOCUMENTS

| | | | |
|---|---|---|---|
| 977,957 | 12/1910 | Leopold . | |
| 1,132,319 | 3/1915 | Fegley | 81/62 |
| 2,720,296 | 10/1955 | Briglia . | |
| 4,290,328 | 9/1981 | Clark | 81/62 |
| 5,379,873 | 1/1995 | Shiao | 81/63.1 X |
| 5,642,794 | 7/1997 | Chuang et al. | 81/63.1 X |
| 5,749,272 | 5/1998 | Phan | 81/62 |
| 5,836,430 | 11/1998 | Vasudera | 81/63.1 X |

*Primary Examiner*—D. S. Meislin
*Attorney, Agent, or Firm*—Rosenberg, Klein & Bilker

[57] ABSTRACT

A reversible ratchet screwdriver in which a shank having annular grooves around the periphery is retained in an axial center hole on a control head at one end of a handle by springs and steel balls, a ratchet shifter is moved in a transverse sliding slot on a shell around the control head to shift two stop plates between engaged position and disengaged position, enabling the shank to be turned with the handle in one direction only, or in two directions.

3 Claims, 5 Drawing Sheets

A-A

REVERSIBLE RATCHET SCREWDRIVER

BACKGROUND OF THE INVENTION

The present invention relates to a screwdriver for turning screws, and more specifically to a reversible ratchet screwdriver.

FIGS. 1 and 2 show a reversible ratchet screwdriver according to the prior art. This structure of reversible ratchet screwdriver comprises a handle 10 having a control head 11 at one end, a shank 14 connected to the control head 11, the shank 14 has a ratchet wheel 140 at its rear end and a tubular coupling portion 141 at its front end for holding a tip, a shell 15 mounted around the control head 11, and a locking ring 16 fastened to the control head 11 to lock the shell 15. The control head 11 comprises a storage chamber 111. A forward control pawl 122 and a backward control pawl 123 are mounted in the storage chamber 111, and respectively engaged with the ratchet wheel 140. A ratchet shifter 120 is mounted in an adjustment hole 150 on the shell 15, having shifting strips 121 respectively pressed on the pawls 122;123 for forward/backward shifting control. A locating plate 13 is mounted in a hole on the control head 11 to secure the shank 14 in place. This structure of reversible ratchet screwdriver is still not satisfactory in function. The drawbacks of this structure of reversible ratchet screwdriver is outlined hereinafter.

1. Because the shank 14 is secured to the control head 11 by the locating plate 13, the shank 14 is not replaceable as desired, and the user shall have to prepare a variety of bits for turning different sizes of screws.
2. It is inconvenient to carry a full set of bits with the reversible ratchet screwdriver and to frequently changing the bit from the tubular coupling portion of the shank.
3. It is difficult to install the locating plate and the ratchet shifter in the control head from both sides, and the locating plate and the ratchet shifter tend to slip from position during the assemblage.

SUMMARY OF THE INVENTION

The present invention has been accomplished to provide a reversible ratchet screwdriver which eliminates the aforesaid drawbacks. According to one aspect of the present invention, the reversible ratchet screwdriver comprises a shank having annular grooves around the periphery is retained in an axial center hole on a control head at one end of a handle by springs and steel balls, a ratchet shifter is moved in a transverse sliding slot on a shell around the control head to shift two stop plates between engaged position and disengaged position, enabling the shank to be turned with the handle in one direction only, or in two directions. Because the shank is retained to the control head by the spring force of the springs through the steel balls, the shank can be disconnected from the control head for a replacement when pulled axially with force to overcome the spring force of the springs. According to another aspect of the present invention, the stop plates are respectively mounted in a respective receiving hole on the control head in front of a respective notch, therefore the stop plates can easily be tilted and disengaged from the ratchet on the shank. According to still another aspect of the present invention, the shank has two tubular coupling portions at two ends, which hold a bit having a cabinet tip and a bit having a Phillips head tip for turning different screws.

DETAILED DESCRIPTION OF THE PREFERRED EMBODIMENT

Figure 1:
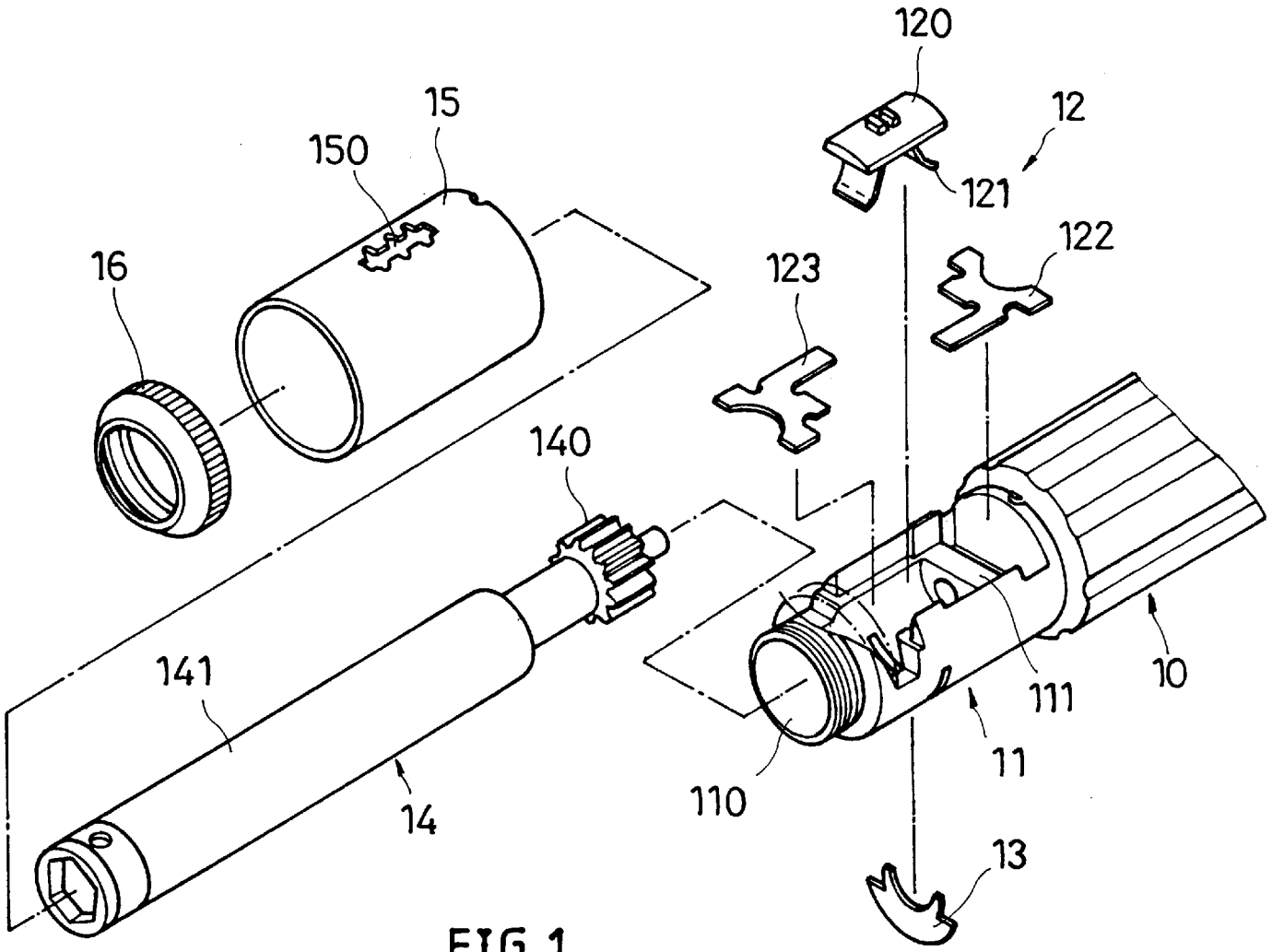
FIG.1 PRIOR ART
FIG. 1 is an exploded view of a reversible ratchet screwdriver according to the prior art.
Figure 2:
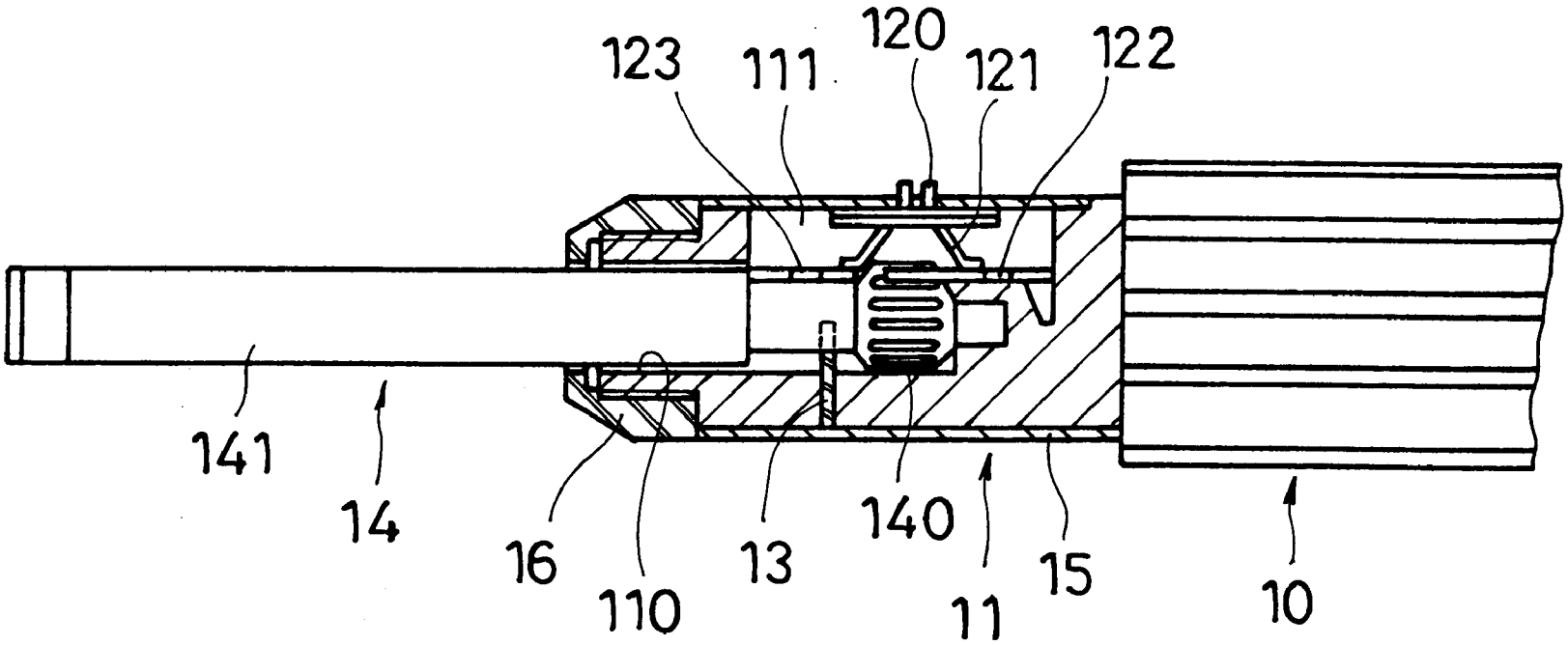
FIG.2 PRIOR ART
FIG. 2 is a sectional assembly view of the reversible ratchet screwdriver shown in FIG. 1.
Figure 3:
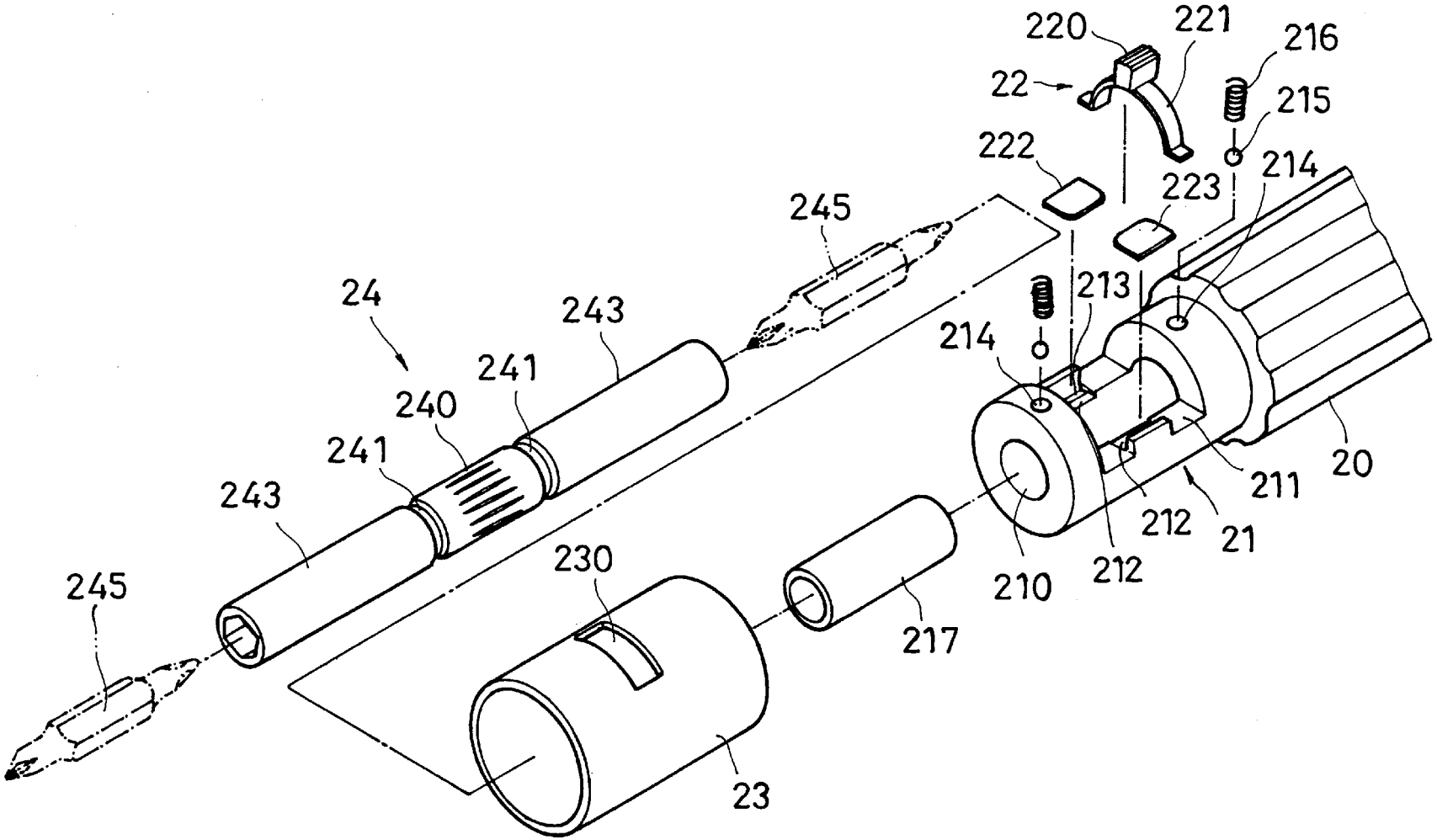
FIG. 3 is an exploded view of a reversible ratchet screwdriver according to the present invention.
Figure 4:
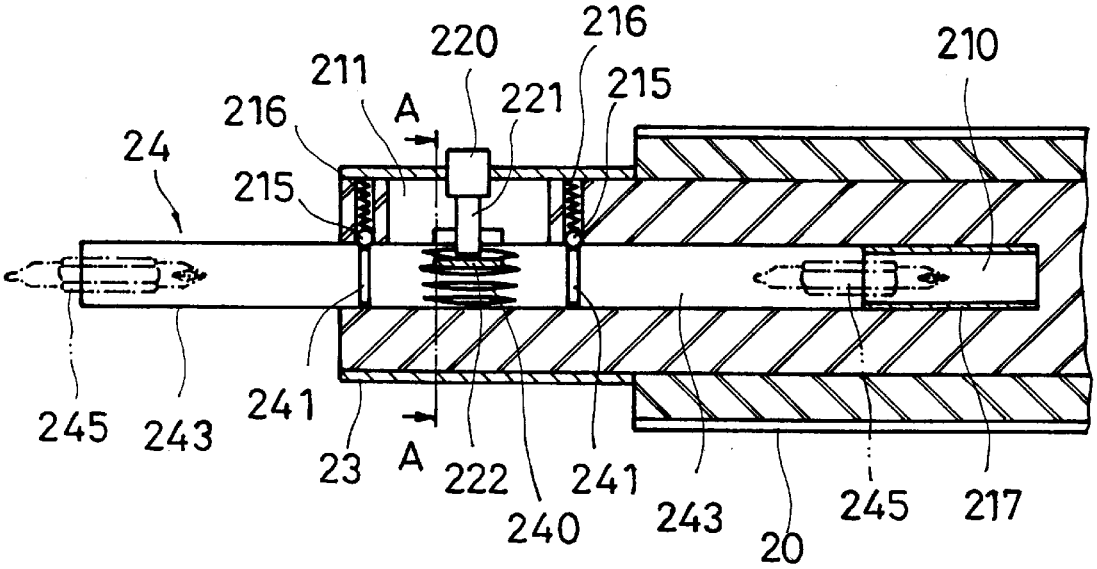
FIG. 4 is a sectional assembly view of the reversible ratchet screwdriver shown in FIG. 3.
Figure 4A:
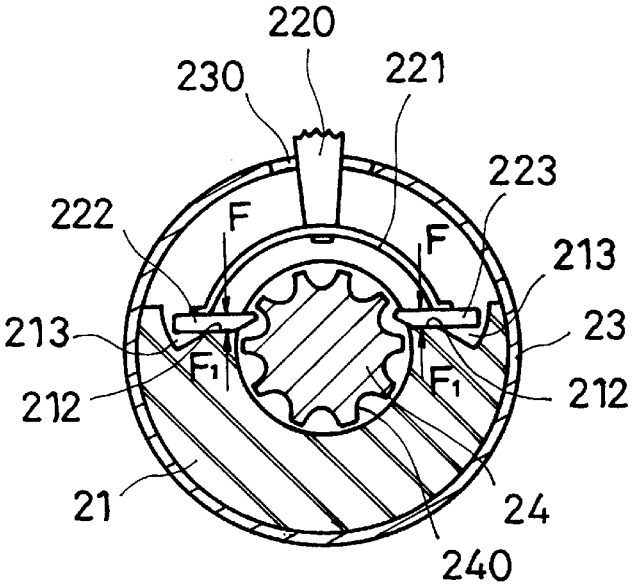
FIG. 4A is a cross sectional view of the present invention showing the ratchet shifter shifted to the middle position.

Referring to FIGS. 3, 4 and 4A, a control head 21 is integral with one end of a handle 20. A shell 23 is mounted around the control head 21. A shank 24 is axially connected to the control head 21. A ratchet shifter 22 is mounted in the control head 21 with a knob 220 thereof extending out of a transverse sliding slot 230 on the shell 23. The control head 21 comprises a radial open chamber 211, an axial center hole 210 piercing through the radial open chamber 211, a stop tube 217 inserted into the axial center hole 210, two receiving holes 212 at two opposite sides of the radial open chamber 211, two notches 213 respectively disposed adjacent to the receiving holes 212, two radial holes 214 respectively disposed at front and rear sides of the radial open chamber 21, two steel balls 215 respectively mounted in the radial holes 214, and two springs 216 respectively mounted in the radial holes 214 and held down by the shell 23 against the steel balls 215. Two stop plates 222;223 are respectively mounted in the receiving holes 212. The ratchet shifter 22 has two pressure arms 221 respectively pressed on the stop plates 222;223. The shank 24 comprises a ratchet 240 on the middle, two tubular coupling portions 243 at two opposite ends for holding a tip 245 respectively, and two annular grooves 241 around the periphery at two opposite sides of the ratchet 240. The stop plates 222;223 are forced into engagement with the ratchet 240 on the shank 24 at two opposite sides. The steel balls 215 are forced by the springs 216 into engagement with the annular grooves 241 on the shank 24 to stop the shank 24 from axial motion.

Referring to FIGS. 4 and 4A again, one tubular coupling portion 243 of the shank 24 is inserted into the axial center hole 210 on the control head 21 and stopped against the stop tube 217 at the bottom of the axial center hole 210, permitting the bit 245 in the respective tubular coupling portion 243 to be received in the stop tube 217, so as to prevent direction contact between the bit 245 and the bottom of the axial center hole 210. When installed, the steel balls 251 are forced by the inside wall of the shell 23 through the springs 261 into engagement with the annular grooves 241 on the shank 24, the ratchet 240 is retained engaged with the stop plates 222;223, and the tubular coupling portion 243 of the shank 24 which extends out of the control head 21 holds another bit 245 for turning a screw. Because the stop plates 222;223 each have two smoothly curved angles at an inner side, the shank 24 can be pulled out of the constraint of the stop plates 222;223 by force for a replacement. When a new shank is inserted into the axial center hole 210 on the control head 21, the steel balls 215 are forced outwards against the springs 216 for permitting the new shank to pass. After the shank is inserted into position, the steel balls 215 are forced by the springs 216 into engagement with the annular grooves 241 on the new shank to secure it in place.

Figure 6:
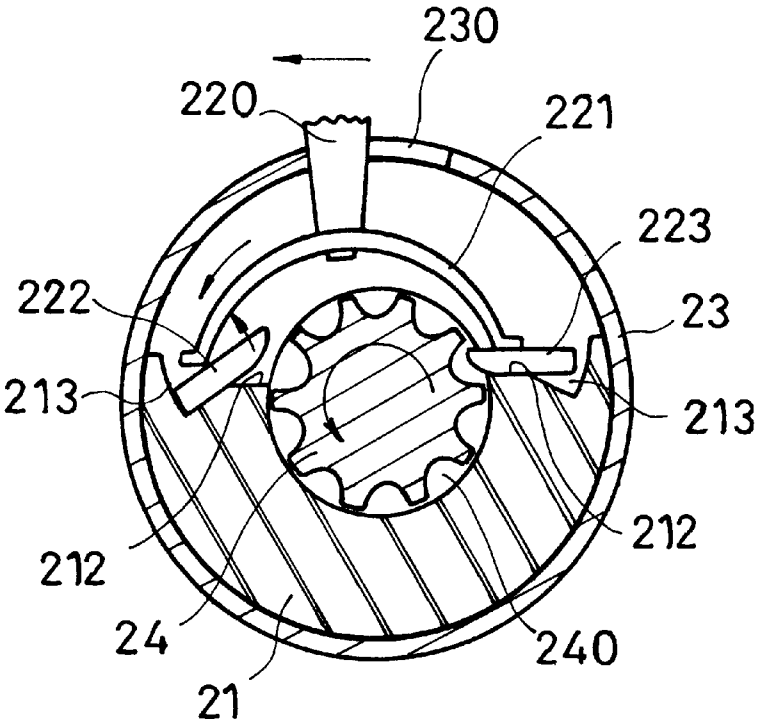
FIG. 6 is still another cross sectional view of the present invention showing the ratchet shifter shifted to the left position.
Figure 5:
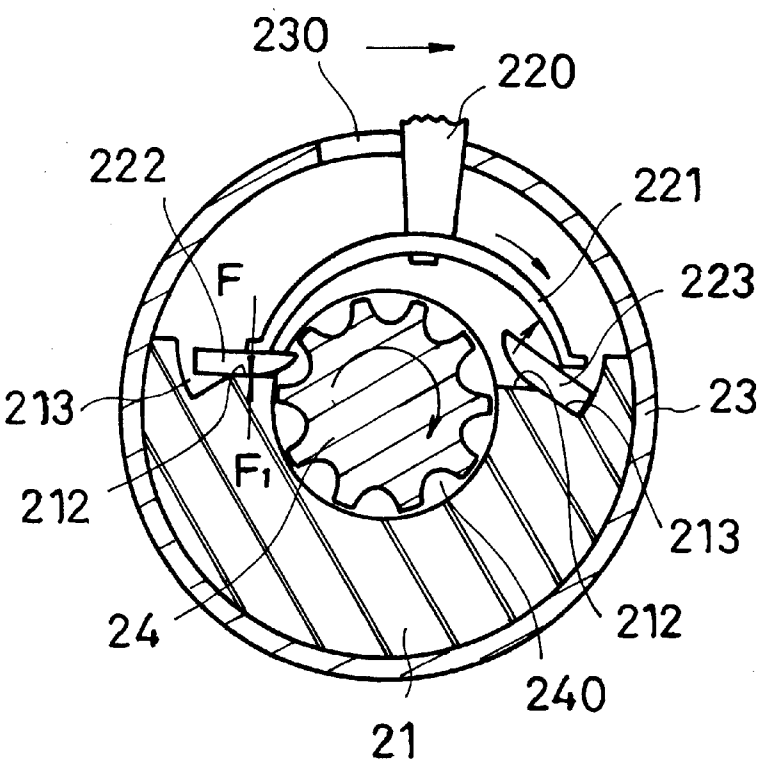
FIG. 5 is another cross sectional view of the present invention showing the ratchet shifter shifted to the right position.

Referring to FIGS. 5 and 6 and FIG. 4A again, the ratchet shifter 22 can be shifted to the right position (see FIG. 5), the left position (see FIG. 6), or the middle position (see FIG. 4A). When the ratchet shifter 22 is shifted to the middle position as shown in FIG. 4A, the stop plates 222;223 are retained in engagement with the ratchet 240 on the shank 24 to stop the shank 24 from rotary motion relative to the control head 21, therefore the shank 24 can be turned with the handle 20 clockwise as well as counter-clockwise. When the ratchet shifter 22 is shifted to the right position, one stop plate, namely, the first stop plate 222 is retained in engagement with the ratchet 240 on the shank 24, and the other stop plate, namely, the second stop plate 223 is tilted (the notches 213 each impart a space for receiving the respective stop plate 222 or 223 in a tilted position) and disengaged from the ratchet 240 on the shank 214, permitting the shank 24 to be turned with the handle 20 counter-clockwise, i.e., the shank 24 is allowed to be turned clockwise relative to the handle 20 but prohibited from being turned counter-clockwise relative to the handle 20 (see FIG. 5). When the ratchet shifter 22 is shifted to the left position, the second stop plate 223 is retained in engagement with the ratchet 240 on the shank 24, and the first stop plate 222 is tilted and disengaged from the ratchet 240 on the shank 214, permitting the shank 24 to be turned with the handle 20 clockwise, i.e., the shank 24 is allowed to be turned counter-clockwise relative to the handle 20 but prohibited from being turned clockwise relative to the handle 20 (see FIG. 6).

Further, a bit with a cabinet tip and a bit with a Phillips head tip may be respectively attached to the tubular coupling portions 243 of the shank 24.

While only one embodiment of the present invention has been shown and described, it will be understood that various modifications and changes could be made thereunto without departing from the spirit and scope of the invention disclosed.

What the invention claimed is:

1. A reversible ratchet screwdriver comprising:

a handle having a control head at one end, said control head comprising a radial open chamber, an axial center hole piercing through said radial open chamber, two receiving holes at two opposite sides of said radial open chamber, two notches respectively disposed adjacent to said receiving holes, two radial holes respectively disposed at front and rear sides of said radial open chamber;

a shell mounted around said control head on said handle, said shell having a transverse sliding slot;

a shank inserted into the axial center hole on said control head, said shank having a ratchet on the middle, two tubular coupling portions respectively disposed at two opposite ends and holding a respective bit for turning screws, and two annular grooves around the periphery at two sides of said ratchet;

two steel balls respectively mounted in the radial holes on said control head;

two springs respectively mounted in the radial holes on said control head and connected between an inside wall of said shell and said steel balls, said springs imparting a downward pressure to said steel balls, causing said steel balls to be retained in engagement with the annular grooves on said shank;

a first stop plate and a second stop plate respectively mounted in the receiving holes on said control head and forced into engagement with the ratchet on said shank at two sides;

a ratchet shifter having a knob extending out of the transverse sliding slot on said shell, and two pressure arms respectively pressed on said first stop plate and said second stop plate, said ratchet shifter being shifted to a right position where said first stop plate is retained in engagement with the ratchet on said shank and said second stop plate is tilted in one notch on said control head and disengaged from the ratchet on said shaft, enabling said shank to be rotated clockwise in the axial hole on said control head and prohibiting said shank from being rotated counter-clockwise in the axial hole on said control head, a left position where said second stop plate is retained in engagement with the ratchet on said shank and said first stop plate is tilted in one notch on said control head and disengaged from the ratchet on said shaft, enabling said shank to be rotated counter-clockwise in the axial hole on said control head and prohibiting said shank from being rotated clockwise in the axial hole on said control head, or a middle position where said first stop plate and said second stop plate are retained in engagement with the ratchet on said shank to stop said shank from rotary motion relative to said control head.

2. The reversible ratchet screwdriver of claim 2, wherein the bit at one tubular coupling portion of said shank has a cabinet tip, and the bit at the other tubular coupling portion of said shank has a cross head tip.

3. The reversible ratchet screwdriver of claim 1, further comprising a stop tube mounted inside the axial center hole on said control head to stop said shank in place and to receive the bit at one tubular coupling portion of said shank.

* * * * *